US007975956B2

(12) United States Patent
Denker

(10) Patent No.: US 7,975,956 B2
(45) Date of Patent: Jul. 12, 2011

(54) EXPANSION REEL MANDREL

(75) Inventor: Wolfgang Denker, Freudenberg (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 29 days.

(21) Appl. No.: 11/922,156

(22) PCT Filed: Jul. 4, 2006

(86) PCT No.: PCT/EP2006/006510

§ 371 (c)(1),
(2), (4) Date: Dec. 13, 2007

(87) PCT Pub. No.: WO2007/003413

PCT Pub. Date: Jan. 11, 2007

(65) Prior Publication Data

US 2009/0020642 A1 Jan. 22, 2009

(30) Foreign Application Priority Data

Jul. 5, 2005 (DE) ..... 10 2005 031 265

(51) Int. Cl.
*B65H 75/24* (2006.01)

(52) U.S. Cl. ..... 242/571.2; 242/576.1

(58) Field of Classification Search ..... 242/571, 242/571.2, 576, 576.1

See application file for complete search history.

(56) References Cited

U.S. PATENT DOCUMENTS

| | | | | |
|---|---|---|---|---|
| 2,989,263 | A * | 6/1961 | Smeets | 242/573.7 |
| 3,085,763 | A * | 4/1963 | Floyd, Jr. | 242/573.8 |
| 3,840,197 | A | 10/1974 | Rodach | |
| 4,113,198 | A * | 9/1978 | Rodach | 242/573.8 |
| 4,342,433 | A * | 8/1982 | Mastriani | 242/571.2 |
| 4,433,814 | A | 2/1984 | Pontes et al. | |
| 4,771,963 | A * | 9/1988 | Gattrugeri | 242/571.2 |
| 5,971,314 | A * | 10/1999 | Essert | 242/530.3 |
| 6,079,662 | A * | 6/2000 | Miller et al. | 242/571.2 |
| 6,196,494 | B1 * | 3/2001 | Rollins et al. | 242/571.2 |

FOREIGN PATENT DOCUMENTS

| | | |
|---|---|---|
| DE | 1 777 229 | 4/1971 |
| DE | 30 28 607 | 2/1982 |
| DE | 35 02 452 | 7/1986 |
| DE | 38 09 298 | 8/1988 |
| DE | 299 06 626 | 8/1999 |
| DE | 100 27 731 | 11/2001 |
| EP | 0 504 452 | 9/1992 |
| EP | 1 172 567 | 1/2002 |
| GB | 948 419 | 2/1964 |
| WO | 00/61952 | 10/2000 |

* cited by examiner

*Primary Examiner* — Sang Kim

(74) *Attorney, Agent, or Firm* — Lucas & Mercanti, LLP; Klaus P. Stoffel

(57) ABSTRACT

The invention relates to a reel mandrel (1) comprising radially mobile expansion segments (2) and/or closing strips (4, 13) arranged on the periphery thereof. According to the invention, the reel mandrel (1) is provided with axially arranged guiding grooves (12) on the periphery thereof, and the expansion segments (2) are provided with ribs (6). The invention further relates to a method for fixing and/or maintaining an expansion segment (2) and/or a closing strip (3, 13) on a reel mandrel (1).

11 Claims, 1 Drawing Sheet

EXPANSION REEL MANDREL

BACKGROUND OF THE INVENTION

The invention concerns a coiler mandrel with radially displaceable expansion segments and/or closing bars arranged on its periphery and a method for locking/clamping the expansion segments and/or closing bars.

Coiling installations are used, for example, for coiling rolled sheet or other materials onto a coiler mandrel and/or for uncoiling a coil. To carry out a coiling operation, the expansion segment is displaced radially outward in such a way that the outer periphery of the expansion segments forms a circle. To uncoil a coil, the coiler mandrel must be smaller in diameter than the inside diameter of the coil in order to hold the coil. To this end, in a coiler mandrel, two diameters can usually be systematically moved into, where only an expanded, maximum diameter has a completely circular configuration.

In previous designs of coiler mandrels of this type, coiler segments are radially displaced by means of wedge surfaces, which are moved by means of push or pull rods. In another previously known design, coiler shell portions are moved about an external center of rotation by means of cylinders.

DE 35 02 452 A1 describes a coiling and/or uncoiling coiler for rolled strip, with a drum that consists of several expansible segments, which are supported with wedge-shaped sliding surfaces against a coiler shaft that is rotatably supported in a coiler housing. A ram is guided in the coiler shaft and is connected with the drum segments by means of a connecting flange. In this regard, an actuator effects a relative axial displacement between the coiler shaft and the ram, which is connected with the segments, and this displacement produces an expanding movement of the segments. In addition, the coiler has a displacing drive that causes the coiler drum to be pushed in and out relative to the strip coil and/or that effects strip center regulation, where the coiler shaft is supported in a stationary coiler housing in a way that allows it to be axially displaced, the actuator has a piston-cylinder unit, which cannot rotate relative to the stationary coiler housing but can be axially displaced for the contracting action of the coiler shaft, a compression spring always keeps the segments in the expanded state, and the displacing drive consists of a piston-cylinder unit, by means of which the coiler shaft can be acted upon to be axially displaced.

EP 0 504 296 B1 discloses a coiler for coiling and/or uncoiling metal strip with strip tension forces of 10 to 1000 kN. It consists of an expandable winding drum, which is supported by a hollow shaft that is mounted on two bearings in a stator. The winding drum is actuated by an actuating cylinder mounted on the hollow shaft via a driving rod that passes through the hollow shaft. A drive motor, which consists of a stator and a rotor and is mounted between the two bearings of the hollow shaft, is coupled to the hollow shaft. In this regard, the hollow shaft is designed as the rotor shaft, and the driving rod is designed as the winding drum shaft supported in the hollow shaft.

German Early Disclosure 1 777 229 describes an expandable coiler mandrel for coiling rolled strip, especially hot-rolled strip, with an inner mandrel body and several expansion segments placed on it. These expansion segments are supported by push rods on wedge surfaces of a wedge bar that is concentrically supported in the mandrel body and that has a number of wedge surfaces, such that the expansion segments are joined by tabs with a wedge bar that is concentrically mounted in the mandrel body.

DE 30 28 607 C2 discloses a rolled strip coiler, which already has a ram that is pretensioned by spring force and held in its expanded position. The ram is acted upon by means of an actuator that is mounted in a stationary and rotationally rigid way in such a way that the segments can be contracted.

The previously known embodiments and designs all require expensive maintenance and servicing. Wedge surface designs must remain in a narrow range in their friction behavior, since otherwise malfunctions occur, such as jamming or shifting of the segments under a load, and this in turn can result in loss of production.

SUMMARY OF THE INVENTION

Therefore, the objective of the invention is to simplify the previously known, mechanically complicated designs and to avoid the aforementioned disadvantages related to their operation. In this regard, it should be simple to change the position of the coiler segments and then to maintain the adjusted or required position in an operationally reliable way.

In accordance with the invention, the solution to this problem is characterized by the fact that, in a coiler mandrel with radially displaceable expansion segments and/or closing bars arranged on its periphery, the coiler mandrel is provided with axially arranged guide grooves on its periphery, and the expansion segments are provided with webs.

Additional embodiments of the coiler mandrel are specified in the relevant dependent claims.

The invention also concerns a method for locking/clamping the expansion segments and/or closing bars, such that the webs of the expansion segments and/or the closing bars are arranged in guide grooves, whose sidewalls have a laterally open, axial bore or a groove, into which a hose is inserted, which expands under pressure and thus exerts a clamping force on the web and/or the closing bar.

Additional embodiments of the method are specified in the relevant dependent claims.

The principle is to position the expansion segments and/or the closing bars in a guide groove by means of a shifting rod and then lock them in place.

The shifting rod can move the expansion segments in both directions by means of levers, cams, wedges, or cones. Actuation can be effected only on the end faces of the expansion segments and can occur only when there is no load.

The expansion segments are clamped by means of hoses. To clamp the expansion segments, the hoses are pressurized, which causes the outside diameter of the hoses to increase. The hoses are inserted in axial bores, which are placed in at least one sidewall parallel to the guide grooves. The bores have openings into the sidewalls or form a groove with a semicircular contour. The hoses expand under pressure in the direction of these openings, which causes a clamping jaw to move, which in turn clamps the expansion segments in the groove.

Hoses or devices of this type that can be acted upon, for example, by a fluid are already known from DE 100 27 731 C1, DE 299 06 626 U1, EP 1 172 567 A1, and WO 2000/061, 952 A1.

The applied clamping forces can be further increased by a lamellar construction within the guide groove, since the holding force doubles with each additional pair of frictional contact surfaces. To this end, for example, the web of an expansion segment and/or the closing bar is provided with a groove, into which fits a web that is joined with the coiler mandrel.

Due to the small amount of machining, including the production of the guide grooves, the cross section of the coiler mandrel is only slightly weakened and therefore can transmit a higher torque than previously known designs.

A specific embodiment of the invention is described in detail below with reference to the highly schematic drawing.

DETAILED DESCRIPTION OF THE INVENTION

Figure 1:
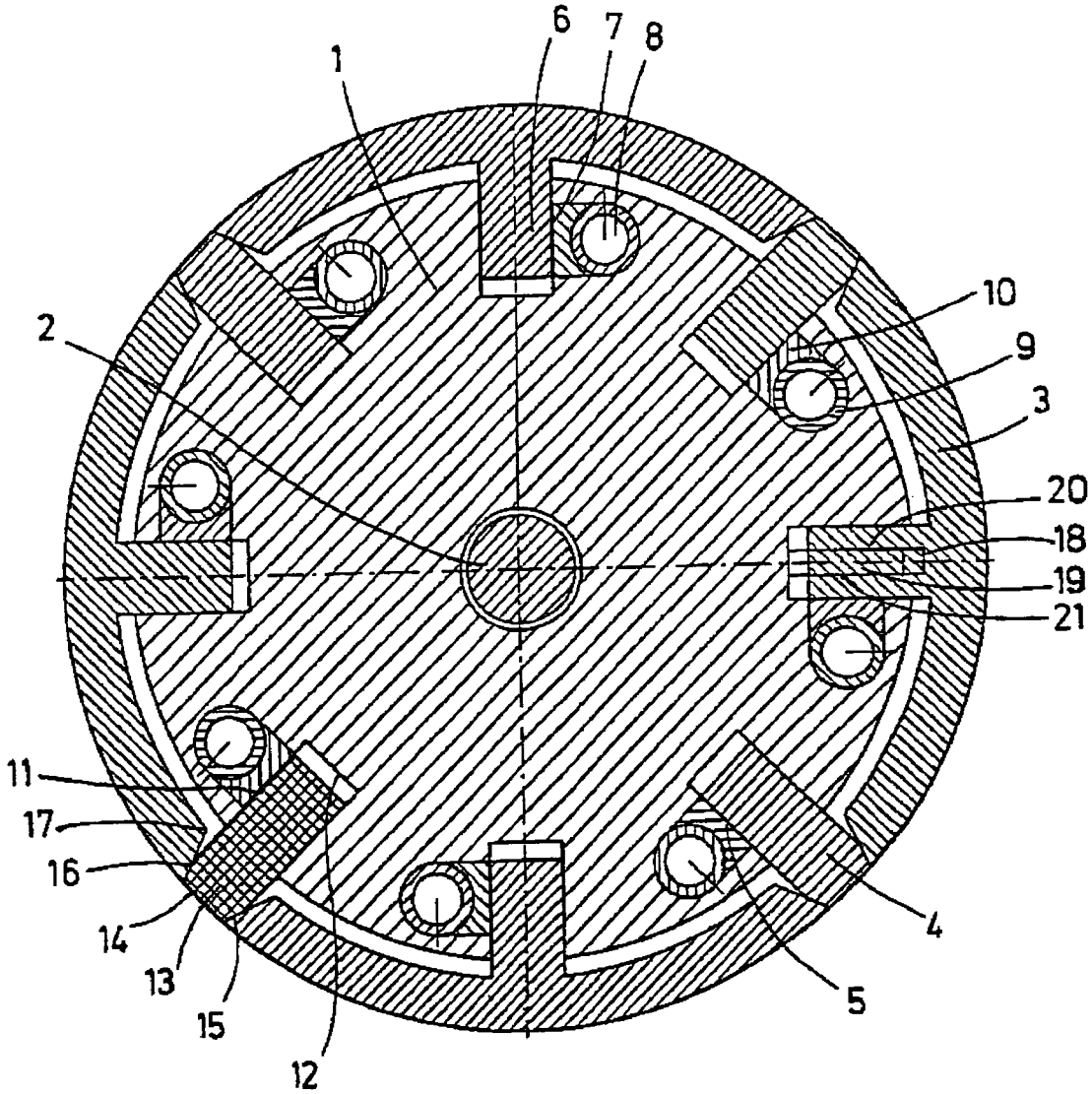
FIG. 1 shows a cross section of a coiler mandrel with expansion segments and closing bars in their outer position.

The sole drawing shows a cross section of a coiler mandrel 1, which has a shifting rod 2 in its center bore. Expansion segments 3 and closing bars 4 are radially positioned in guide grooves 12 by means of the shifting rod 2. In this regard, expansion segments 3 and closing bars 4 form a closed circle in a radially outer position. In a radially inner position, gaps form between the expansion segments 3, because the closing bars 4 are positioned farther radially inward.

Each expansion segment 3 is held and guided in the guide groove 12 by a web 6. A bore that runs in the axial direction is formed in the sidewall 7 of the guide groove 12. The bore 8 is open towards the guide groove 12. A hose 9 is inserted in the bore 8. In the illustrated embodiment, a clamping jaw 5,10 is located between the hose 9 and the web 6. In a different embodiment (not shown), there is direct contact between the hose 9 and the web 6.

An axial bore 8 is also located in the sidewall 11 of the guide groove 12 for a closing bar 13. The outer end face 14 of the closing bar 13 has a contour 15 that corresponds to the contour 16 of the outer edges 17 of the expansion segments 3 and forms a contact surface.

In a special embodiment, the web 6 has a groove 18 into which extends a web 19 that is joined with the coiler mandrel 1. This results in the formation of two additional frictional contact surfaces 20, 21, which increase the clamping force.

LIST OF REFERENCE NUMBERS

1 coiler mandrel
2 shifting rod
3 expansion segment
4 closing bar
5 clamping jaw
6 web
7 sidewall
8 bore
9 hose
10 clamping jaw
11 sidewall
12 guide groove
13 closing bar
14 end face
15 contour
16 contour
17 outer edge
18 groove
19 web
20 frictional contact surface
21 frictional contact surface

The invention claimed is:

1. A coiler mandrel, comprising: a cylindrical body having a peripheral outer surface and guide grooves arranged axially in the outer surface; and radially displaceable expansion segments, each of the expansion segments having an outer member that is curved to correspond to and project over a portion of the outer surface of the cylindrical body, and a web that projects radially inwardly from the outer member, each web being displaceably arranged in a respective one of the guide grooves so that each of the outer members covers a portion of the outer surface of the cylindrical body and so that the expansion segments are radially displaceable, wherein at least one sidewall (7) of the guide groove (12) or at least one sidewall of the web is designed with an axial bore (8) or a groove, wherein the bore is open toward the guide groove, a clamping jaw being arranged in the axial bore (8) so as to be movable perpendicular to a radius of the cylindrical body, and a hose is inserted in the axial bore or groove in the sidewall of the guide groove or of the web, the hose being expandable under pressure so as to push the clamping jaw against the web to exert a clamping force on the web.

2. The coiler mandrel in accordance with claim 1, wherein each outer member extends over the outer surface of the cylindrical body to a point where an edge of the outer member is in proximity to an edge of another outer member, and further comprising closing bars arranged in axial grooves in the outer surface of the cylindrical body in an area of the proximity of the outer member edges, each of the closing bars being radially displaceable in one of the grooves so as to support the edges of the outer member in the area of proximity.

3. The coiler mandrel in accordance with claim 1, wherein the web (6) is designed with a clamping jaw (5, 10) in the open, axial bore (8) or the groove.

4. The coiler mandrel (1) in accordance with claim 1, wherein the web (6) is provided with a radially oriented groove (18).

5. The coiler mandrel (1) in accordance with claim 4, wherein the coiler mandrel (1) is designed with a radially projecting web (19) in the guide groove (12) so as to engage in the radially oriented groove (18).

6. The coiler mandrel (1) in accordance with claim 1, wherein the coiler mandrel (1) is designed with a clamping jaw (5, 10) in the open, axial bore (8) or the groove.

7. A method for locking/clamping the expansion segments (3), which are arranged on the periphery of a coiler mandrel (1) in accordance with claim 1, wherein the webs (6) of the expansion segments (3) are arranged in guide grooves (12), whose sidewalls (7, 11) have a laterally open, axial bore (8) or a groove, into which a clamping jaw is inserted so as to be movable perpendicular to a radius of the cylindrical body, and into which a hose (9) is inserted, which expands under pressure to push the clamping jaw against the web to exert a clamping force on the web (6).

8. The method in accordance with claim 7, wherein the hose (9) acts directly on the web (6) of the expansion segment (3).

9. The method in accordance with claim 7, wherein the hose (9) acts indirectly on the web (6) of the expansion segment (3).

10. The method in accordance with claim 7, wherein the hose (9) is acted upon by a fluid.

11. A coiler mandrel, comprising: a cylindrical body having a peripheral outer surface and guide grooves arranged axially in the outer surface; and closing bars radially displaceably arranged in a respective one of the guide grooves, wherein at least one sidewall of the guide grooves is designed with an axial bore or a groove, wherein the bore or groove is open toward the guide groove, a clamping jaw being arranged in the axial bore so as to be movable perpendicular to a radius of the cylindrical body, and a hose is inserted in the axial bore or groove in the sidewall of the guide grooves, the hose being expandable under pressure so as to push the clamping jaw against the closing bars to exert a clamping force on the closing bars.

* * * * *